US008176965B1

(12) United States Patent
Motosko et al.

(10) Patent No.: US 8,176,965 B1
(45) Date of Patent: May 15, 2012

(54) HURRICANE PROTECTION SCREENING AND SYSTEM

(76) Inventors: Stephen J. Motosko, Sarasota, FL (US); Stephen Motosko, III, Sarasota, FL (US)

( * ) Notice: Subject to any disclaimer, the term of this patent is extended or adjusted under 35 U.S.C. 154(b) by 318 days.

(21) Appl. No.: 12/349,602

(22) Filed: Jan. 7, 2009

(51) Int. Cl.
*E06B 9/00* (2006.01)

(52) U.S. Cl. ..... 160/328; 52/202; 52/222; 24/514; 24/517

(58) Field of Classification Search ..... 160/328, 160/327, 329, 354, 368.1, 264, DIG. 7, 399, 160/402, 349.1; 52/202, 222; 24/327, 489, 24/495, 512, 514, 516, 517, 518
See application file for complete search history.

(56) References Cited

U.S. PATENT DOCUMENTS 1,977,165 A * 10/1934 Williams ..... 160/354
2,045,317 A * 6/1936 Sobie ..... 112/416
2,169,103 A * 8/1939 Lesley ..... 160/179
2,321,078 A * 6/1943 Greene ..... 160/238
2,455,237 A * 11/1948 Davis ..... 410/97
2,880,797 A * 4/1959 Alvarez et al. ..... 160/328
3,173,539 A * 3/1965 Looker ..... 206/597
3,292,685 A * 12/1966 Clark ..... 160/26
3,480,069 A * 11/1969 Handwerker ..... 160/354
3,521,927 A * 7/1970 Barry ..... 296/100.16
3,732,913 A 5/1973 Wrono
3,750,740 A * 8/1973 Newman ..... 160/354
4,044,813 A * 8/1977 Emmons ..... 160/369
4,657,062 A * 4/1987 Tuerk ..... 160/243
4,781,235 A 11/1988 Hedstrom et al.
5,307,859 A * 5/1994 Kraeutler ..... 160/264
5,566,734 A * 10/1996 Levy et al. ..... 160/84.04
6,068,042 A * 5/2000 Blond ..... 160/330
6,176,050 B1 1/2001 Gower
6,263,949 B1 7/2001 Guthrie, Jr.
6,341,455 B1 1/2002 Gunn
6,502,355 B1 1/2003 Bori
6,658,801 B2 12/2003 Kilduff et al.
6,824,637 B2 11/2004 Mullet et al.
6,851,464 B2 2/2005 Hudoba et al.
6,865,852 B2 3/2005 Gower
6,886,300 B2 5/2005 Hudoba et al.
7,243,402 B2 * 7/2007 Andersen et al. ..... 24/532
2002/0162287 A1 11/2002 Bork et al.
2003/0159372 A1 8/2003 Motro
2004/0154242 A1 8/2004 Hudoba et al.
2007/0193137 A1 8/2007 DeBoth
2007/0204533 A1 9/2007 Gower
2007/0227083 A1 10/2007 Skobba
2007/0227084 A1 10/2007 Skobba
2008/0120916 A1 5/2008 Borona et al.

* cited by examiner

*Primary Examiner* — David Purol
(74) *Attorney, Agent, or Firm* — Gifford, Krass, Sprinkle, Anderson & Citkowski, P.C.

(57) ABSTRACT

Hurricane protection screening and system including a length of flexible screening material having a substantially uniform continuous cross-section and being sized in length to substantially exceed a height of a building opening and sized in width to exceed or equal a width of the building opening. A plurality of separate spaced, parallel thickened areas are connected to and extend along the entire length of the screening material and are spaced apart over the width thereof, one of the thickened areas extending along each longitudinal side margin of the screening material. The system includes x-shaped buckles each configured for attachment to an upper or lower end of one of the thickened areas of each screen panel, the buckles themselves connectable to a frame of the building opening.

11 Claims, 7 Drawing Sheets

18
D
16
10
A
B
22
24
26
12
14
20
30
38
E
14
32
36
C

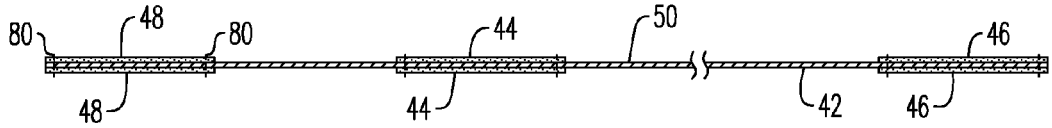
FIG. 9
FIG. 9A
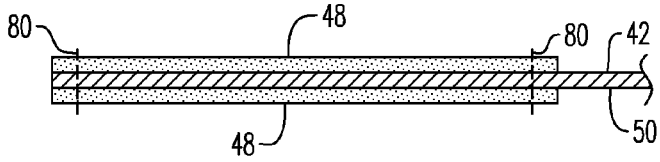
FIG. 9B
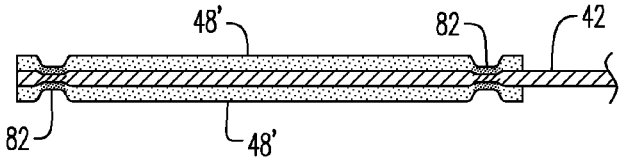
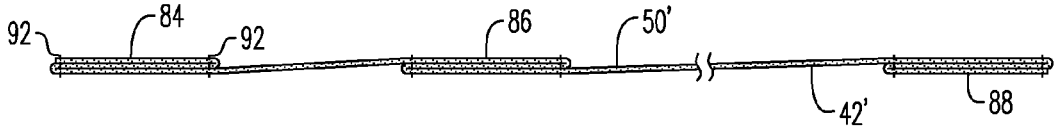
FIG. 10
FIG. 10A
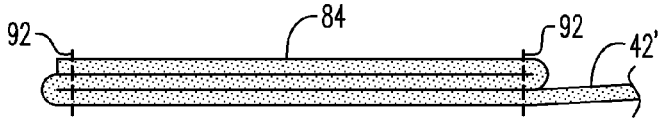
FIG. 10B
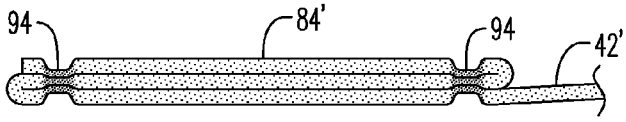

HURRICANE PROTECTION SCREENING AND SYSTEM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to removable shutters, protective panels and screens for building openings such as windows and doors which afford protection against wind and flying object damage during storms and hurricanes, and more particularly to a storm and hurricane protection screening material marketed in bulk rolls and a system incorporating cut sections of the screening material in combination with unique buckles which anchor the selectively cut material over a building opening.

2. Description of Related Art

Tropical storms, tornadoes and hurricanes are wrecking increasing amounts of havoc on building property, perhaps due to the increasing frequency of such storms and an increased building population closer to water and being in harm's way of a tropical storm or hurricane. Considerable effort and expense has now gone into providing a broad variety of removable apparatus which are designed to afford enhanced levels of protection against building damage in the face of high winds and flying objects which are carried in high velocity airborne fashion and are capable of inflicting substantial damage, particularly to the building openings such as doors and windows. However, many of these protective apparatus are bulky, difficult to install, remove and store, complex and expensive and may not truly afford a level of building window and door protection anticipated therefrom. One example is in the form of custom hurricane screens which are specially adapted and reinforced for each building opening.

U.S. Patent Application Publication 2008/0120916 to Borona et al. discloses a method of constructing a fabric storm protection cover according to the size of the opening to be covered and the construction parameters of the building. Fabric storm coverings for building openings are taught by Hudoba et al. in U.S. Pat. No. 6,851,464, U.S. Pat. No. 6,886,300 and U.S. Application Publication 2004/0154242.

Mullet et al. teaches a method and apparatus for manufacturing a flexible three-ply windlocking curtain in U.S. Pat. No. 6,824,637. A hurricane screen attachment system is disclosed by DeBoth in U.S. Patent Application Publication 2007/0193137.

U.S. Patent Application Publications 2007/0227083 and 2007/0227084 to Skobba disclose removable, flexible storm shutters for windows and doors. A combined sun screen and storm window is taught by Hedstrom et al. in U.S. Pat. No. 4,781,235.

Wrono teaches a roll-up slatted shade assembly in U.S. Pat. No. 3,732,913. U.S. Pat. No. 6,658,801 to Kilduff et al. discloses a portable fire curtain system to prevent wind from blowing through building openings.

An exterior covering for protecting wall openings from wind and rain damage and burglary is disclosed in U.S. Pat. No. 6,341,455 to Gunn. Gower discloses a flexible wind abatement device in U.S. Pat. No. 6,865,852.

U.S. Patent Application Publication 2002/0162287 to Bork et al. discloses a building closure for temporarily closing a wall opening. Flexible wind abatement devices are taught by Gower in U.S. Pat. No. 6,176,050 and U.S. Application Publication 2007/0204533.

Motro teaches a storm panel formed of a film material in U.S. Patent Application Publication 2003/0159372. U.S. Pat. No. 6,263,949 to Guthrie, Jr. discloses a hurricane resistant screen assembly.

U.S. Pat. No. 6,502,355 to Bori discloses a storm cover mounted directly onto an exterior glass surface such as a glass window or glass door for protecting the glass from impact by wind driven objects.

The present invention overcomes many of the disadvantages of the above prior art by providing an affordable, easily installable storm and hurricane protection screening which is easily adaptable to a broad range of building opening sizes while affording a high level of building protection by strenuously resisting penetration therethrough by flying objects during such tropical storms and hurricanes. Commercially available in roll form, the protective screening may be easily cut to both length and width to accommodate the size of each building opening without the further need for expensive custom reinforcement of the material thereafter. By providing unique buckles at one or both ends of a plurality of spaced thickened areas formed onto the screening material for added strength, installation and removal is an easy task, along with storage of each of the screening material when not in use. Substantial economy is realized by marketing the product in bulk roll form for easy trimming to fit each opening.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to hurricane protection screening and system including a length of flexible screening material having a substantially uniform continuous cross-section and being easily sizable in length from a roll of screening material to substantially equal a height of a building opening and sized in width to exceed or equal a width of the building opening. A plurality of separate spaced, parallel thickened areas are connected to and extend along an entire length of one or both sides of the screening material and are spaced apart over the width thereof, one of the thickened areas extending along each longitudinal side margin of the screening material. The system also includes unique buckles or anchors each configured for attachment to an upper or lower end of one of the thickened areas, the buckles themselves connectable to a frame of the building opening directly or through a variable length belt or strap.

It is therefore an object of this invention to provide tropical storm and hurricane protection screening in bulk form ready for selective cutting both lengthwise and widthwise to fit a broad range of building opening sizes.

Another object of this invention is to provide an economical means for installing flexible screening material over building openings to reduce the likelihood of wind and flying object impact damage during tropical storms and hurricanes.

Yet another object of this invention is to provide protection screening for building openings which may be easily cut both lengthwise and widthwise to provide a custom fit over each building opening of a residential or commercial building.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

FIG. 9 is a cross sectional view of another embodiment of the screening material of the invention.

FIG. 9A is an enlargement of the left hand portion of FIG. 9.

FIG. 9B is a view similar to FIG. 9A showing an alternate attaching means of the connecting reinforcing strap to the screening material to form the thickened areas.

FIG. 10 is yet another embodiment of the screening material of the invention.

FIG. 10A is an enlargement of the left end portion of FIG. 10.

FIG. 10B is a view similar to FIG. 10A depicting an alternate form of securing the folded material together to form the thickened areas.

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
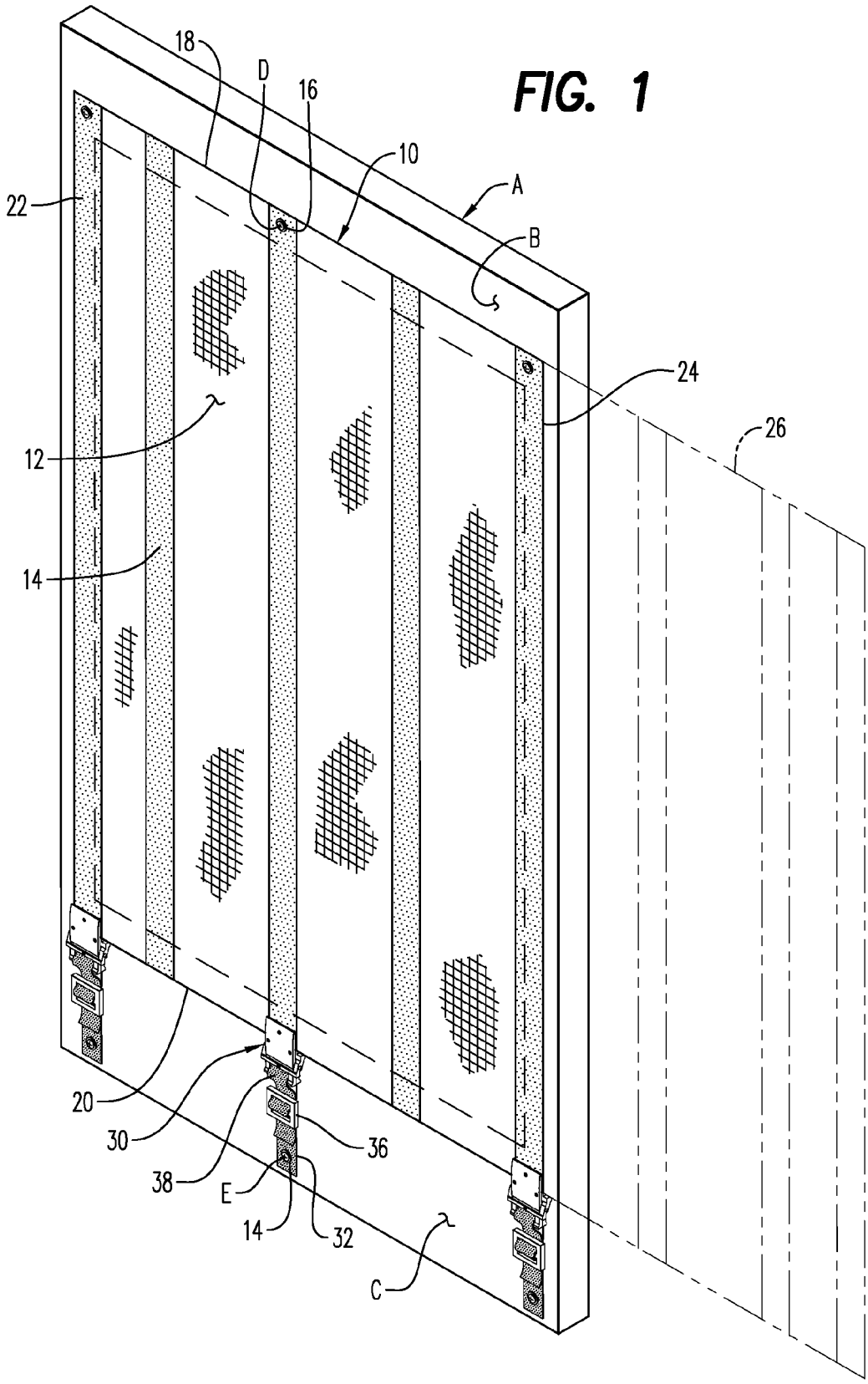
FIG. 1 is a perspective view of one embodiment of the invention shown attached over a building opening, the excess material (shown in phantom) having been severed from a full width of bulk screening material.
Figure 2:
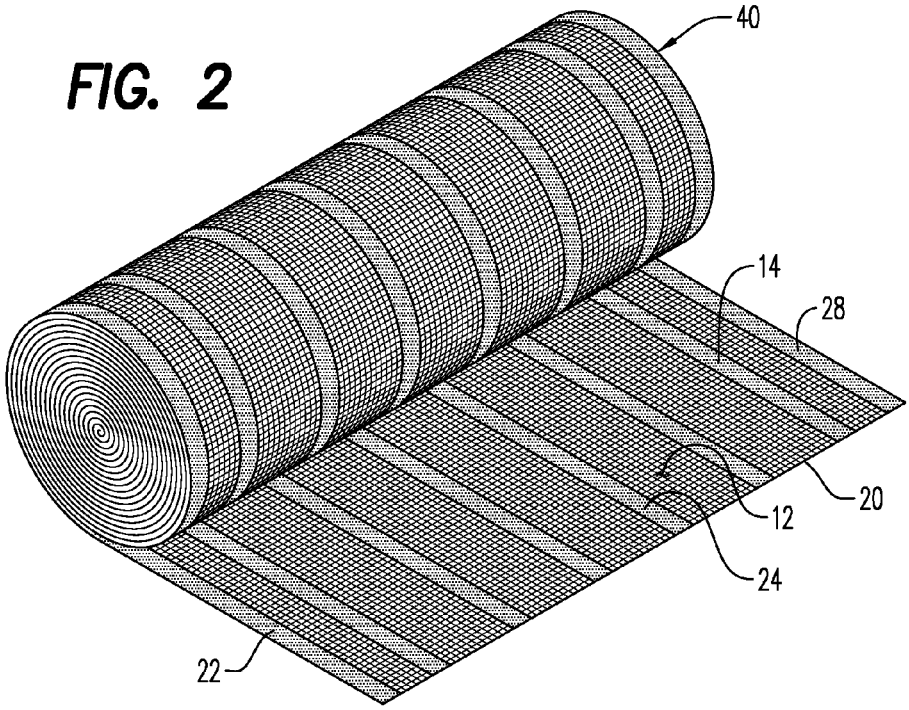
FIG. 2 is a perspective view of a roll of the screening material (in bulk) from which sections like that shown in FIG. 1 are to be severed or cut.

Referring now to the drawings and firstly to FIGS. 1 and 2, one embodiment of the invention as supplied at a commercial retail store is shown in FIG. 2 generally at numeral 40. The beneficial economy of the invention is derived from providing the basic screening material 12 in roll form 40. The flexible screening or mesh material 12 is of a heavy duty polypropylene woven fabric preferably available under the name TENCATE PERMATRON by Tencate Geosynthetics typically utilized to custom fabricate flexible hurricane window protection screening utilizing heavy sewing equipment to hem and reinforce all margins therearound.

However, the roll 40 of the screening material 12 is reinforced by thickened areas 22, 24 and 28 permanently attached to the screening material 12 and coextensive therewith. In the preferred embodiment 40, a total of eight such thickened areas, each in the form of a fabric strap, are provided, two of which 22 and 28 are connected along the side margins of the screening material 12.

When roll 40 of screening material 12 is severed transversely at first cut line 20 and then again across the roll 40 at a desired material length at second cut line 18 to match the height of a building opening A, a screen panel 10 is formed. The first cut line 20 is a raw edge of screening material 12 does not have to be doubled over or hemmed or reinforced in some fashion for strength to facilitate securing a rectangular panel thereof onto transverse frames B and C of the building opening A.

As best seen in FIG. 1, a typical building opening A is narrower in length than the width of the roll 40 of screening material 12 in FIG. 2. Therefore, the screening material 12 will have to be severed lengthwise preferably along the outer margin of one of the longitudinal thickened areas 14 after being cut from the roll 40 along the second cut lines 18 and the first cut line 20. The remainder of the material 26 (shown in phantom) is thereafter removed for other usages or disposal.

Figure 3:
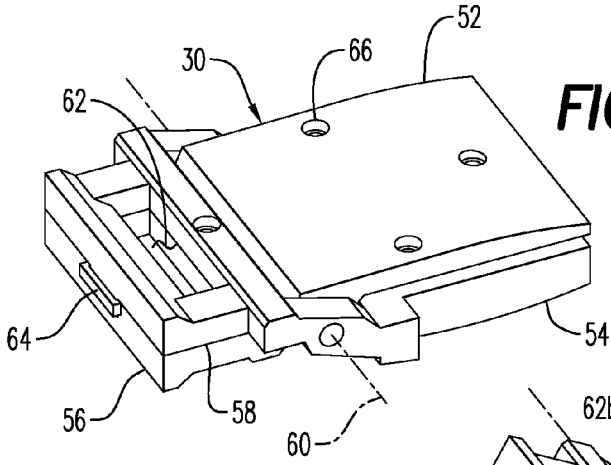
FIG. 3 is a perspective view of one embodiment of a self-engaging buckle of the invention system in a closed position.
Figure 4:
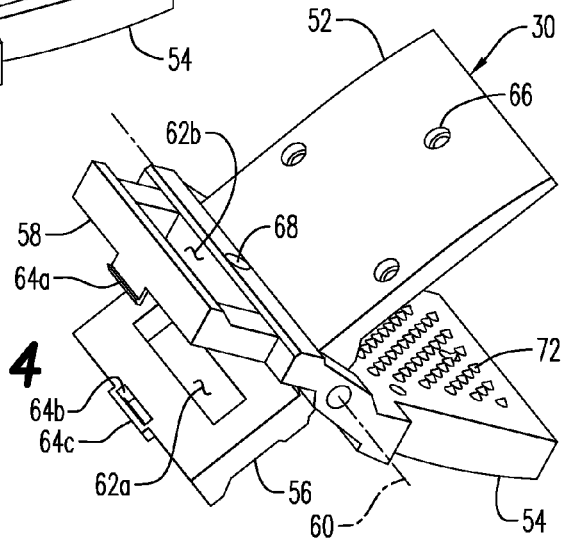
FIG. 4 is a perspective view of FIG. 3 in an open position.
Figure 5A:
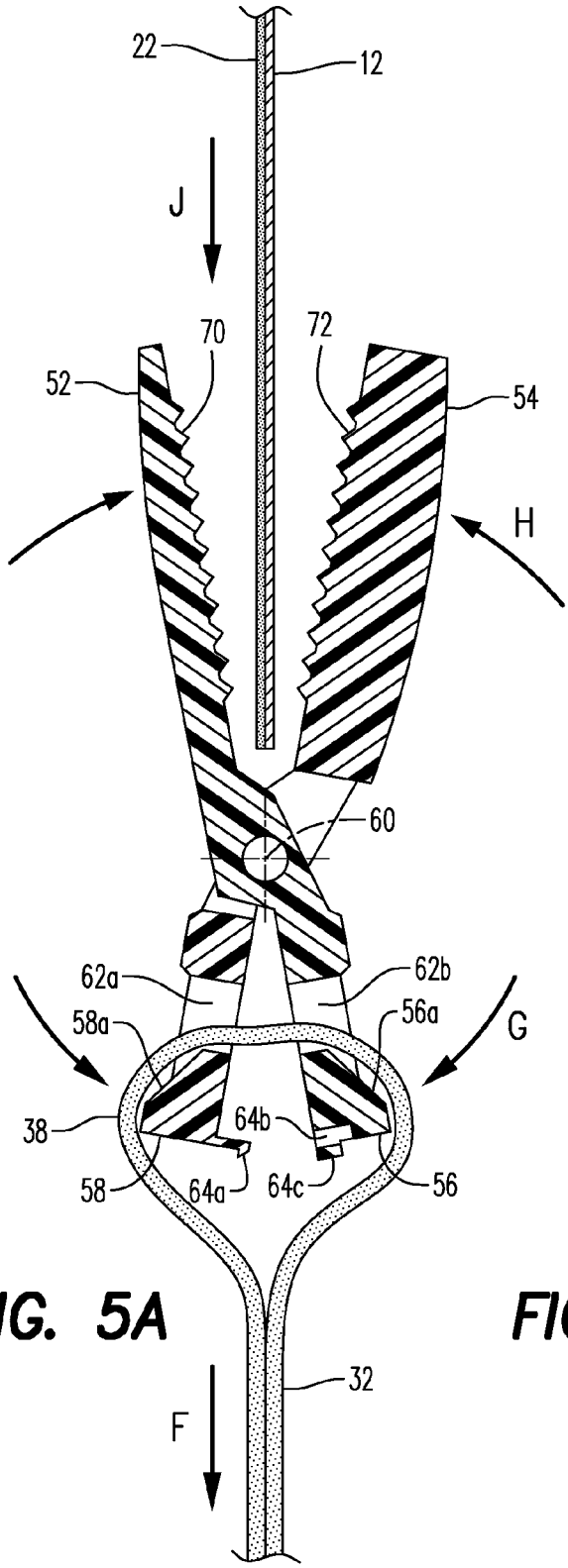
FIG. 5A is a cross sectional view of the self engaging buckle in position ready for grippingly engaging a lower margin of a thickened area of a panel of flexible screening material cut from the roll shown in FIG. 2.
Figure 5B:
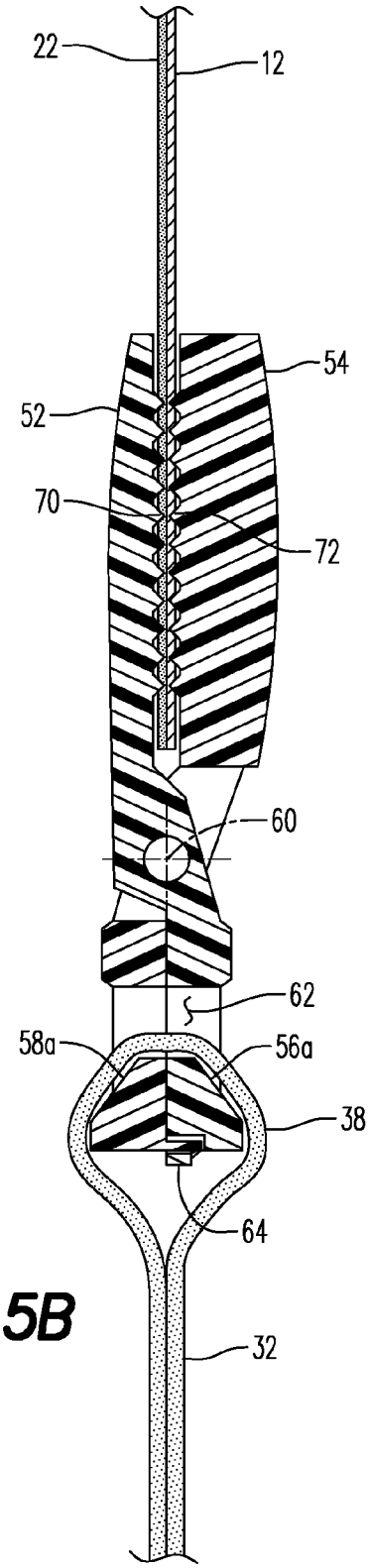
FIG. 5B is a cross sectional view of the self engaging buckle in the closed position.
Figure 8:
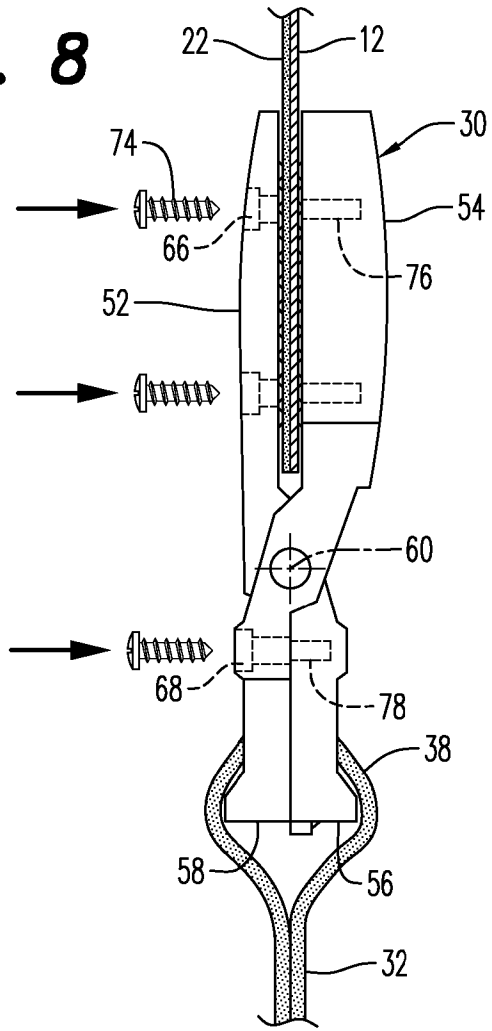
FIG. 8 is a side view of FIG. 5B showing the installation of retaining fasteners to maintain the gripping engagement of the jaws of the buckle around the lower thickened area.

One method of anchoring the upper margin of the screen panel 10 is to install grommets 16 near the ends of two or more of the reinforced thickened areas 22, 24 and 14. These grommets 16 will slidably fit over anchors or screws D which have been installed into the upper transverse frame B of the building opening. Although these same grommets 16 may also be installed at the lower ends of these thickened areas 14, 22 and 24, it is preferred that a buckle 30 be utilized for anchoring the lower margin of the screening panel 10 to the transverse lower frame C. Referring additionally to FIGS. 3 to 5, the facing surfaces 70 and 72 of jaws 52 and 54 of each of the buckles 30 include staggered penetrating points which pierce into and grip the exposed surfaces of the thickened areas and the flexible screening material 12 as the jaws 52 and 54 are closed in the direction of arrow H after the thickened areas 14 and 22 are inserted into the jaws 52 and 54 in the direction of arrow J in FIG. 5A.

Figure 7:
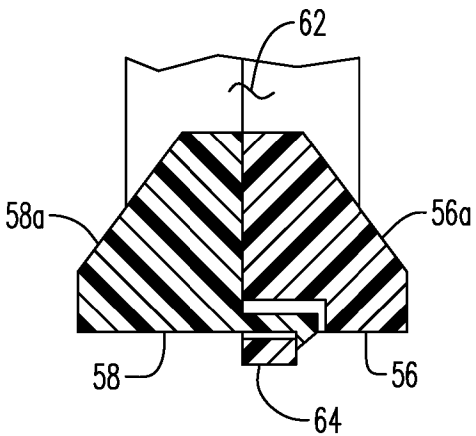
FIG. 7 is an enlarged area similar to FIG. 6 of FIG. 5B.
Figure 6:
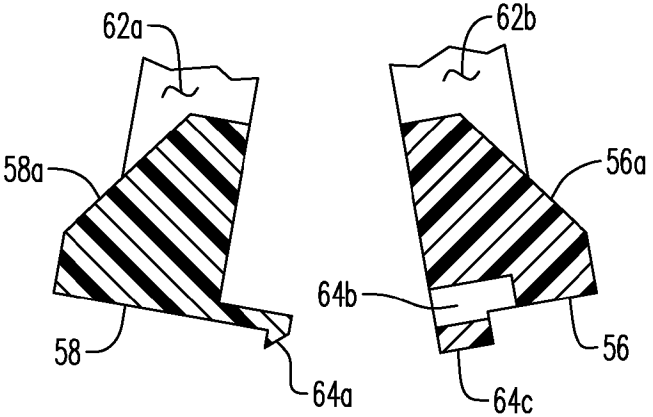

A separate looped strap 32 is anchored at one end thereof to the transverse frame C by heavy screws E through grommets 15 which have been installed into the strap 32. The other end 38 of the strap 32 is fed through a conventional buckle 36 and then through elongated slot formed of mating slot portions 62*a* and 62*b* in the proximal ends 56 and 58 of each of the jaws 52 and 54. The other end 38 is then fed back through the buckle 36 and tightened by pulling downwardly in the direction of arrow F in FIG. 5A. In doing so, the proximal ends 56 and 58 are forced to move together inwardly in the direction of arrow H, causing the facing surfaces 70 and 72 to bite into the screening material 12 and the thickened area 22. As best seen in FIGS. 6 and 7, an interlocking tab 64*a* and mating cavity 64*b* releasably engage one to another as shown in FIG. 7 to hold the jaws 52 and 54 together. After the jaws 52 and 54 have been secured together as above described, locking screws 74 may be installed into molded cavities 76 and 78 having counter bores 66 and 68 to insure that the resiliency of the buckles 30 does not cause any unintentional weakening of the gripping interconnection between the jaws 52 and 54 and the screening material 12 and the thickened areas 22 and 24.

Referring now to FIGS. 9A and 9B, an alternative embodiment of the combination of the screening material 50 and the thickened areas 44, 46, and 48 is there shown. In FIGS. 9 and 9A, the thickened areas 44, 46, and 48 are in the form of a fabric reinforcing strap positioned on each side of the screening material 50 which are send in place at 80 for added reinforcement and longitudinal strength of the screening material 50. In FIG. 9B, an alternative means for attaching these reinforcing straps 48' is in the form of a heat weld 82 along each of the longitudinal margins of the reinforcing straps 48'.

Referring now to FIGS. 10, 10A and 10B, the thickened areas 84, 86, and 88 are formed by the folding of the screening material 50' itself in a compressed and flattened "Z" shape, this folded arrangement being secured by stitching along 92. Again, alternately, the "Z" fold 84' as seen in FIG. 10B may be secured by heat welding at 94 adjacent to the margins of the thickened area 84'.

Figure 11:
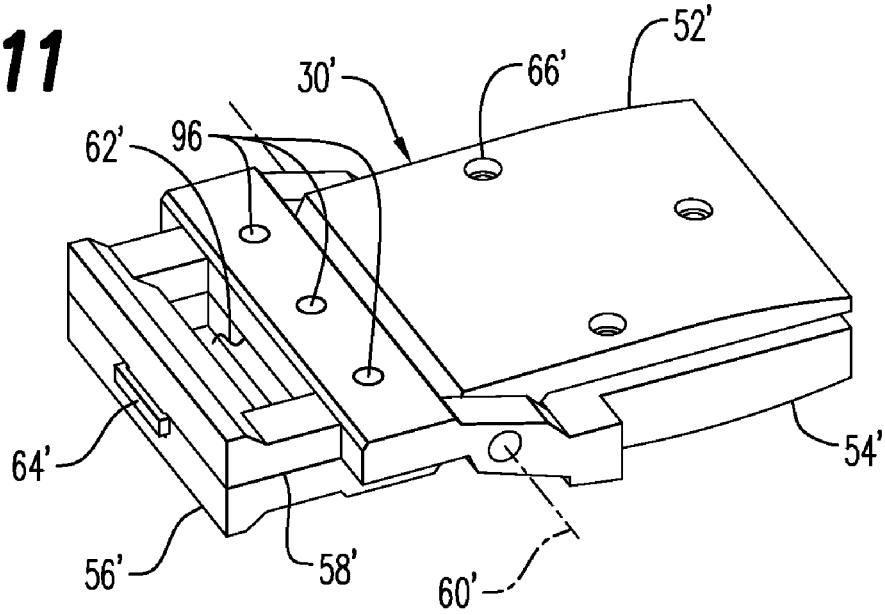
FIG. 11 is a perspective view of an alternative embodiment of the buckle/anchor.
Figure 12:
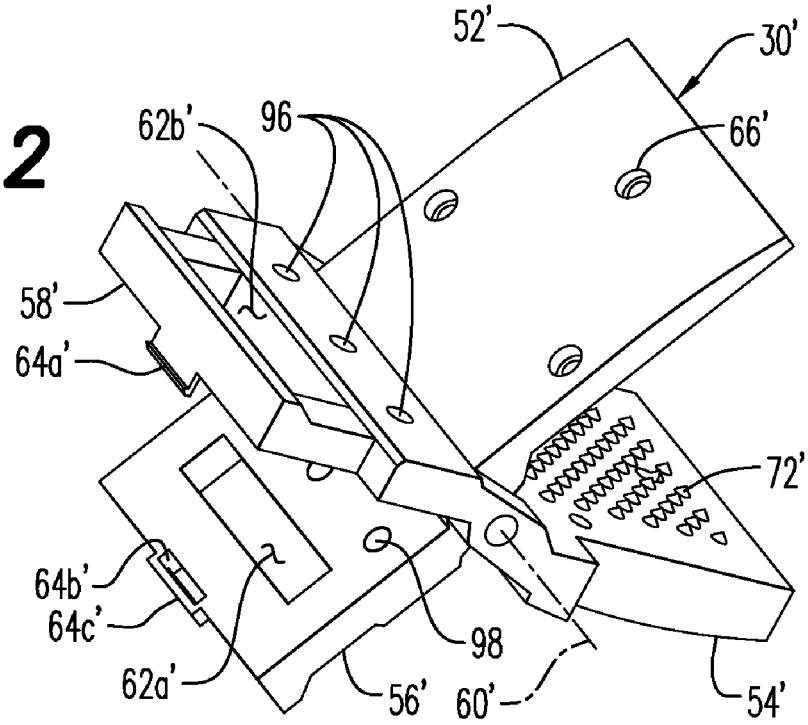
FIG. 12 is a perspective view of FIG. 11 in the open position.
Figure 13:
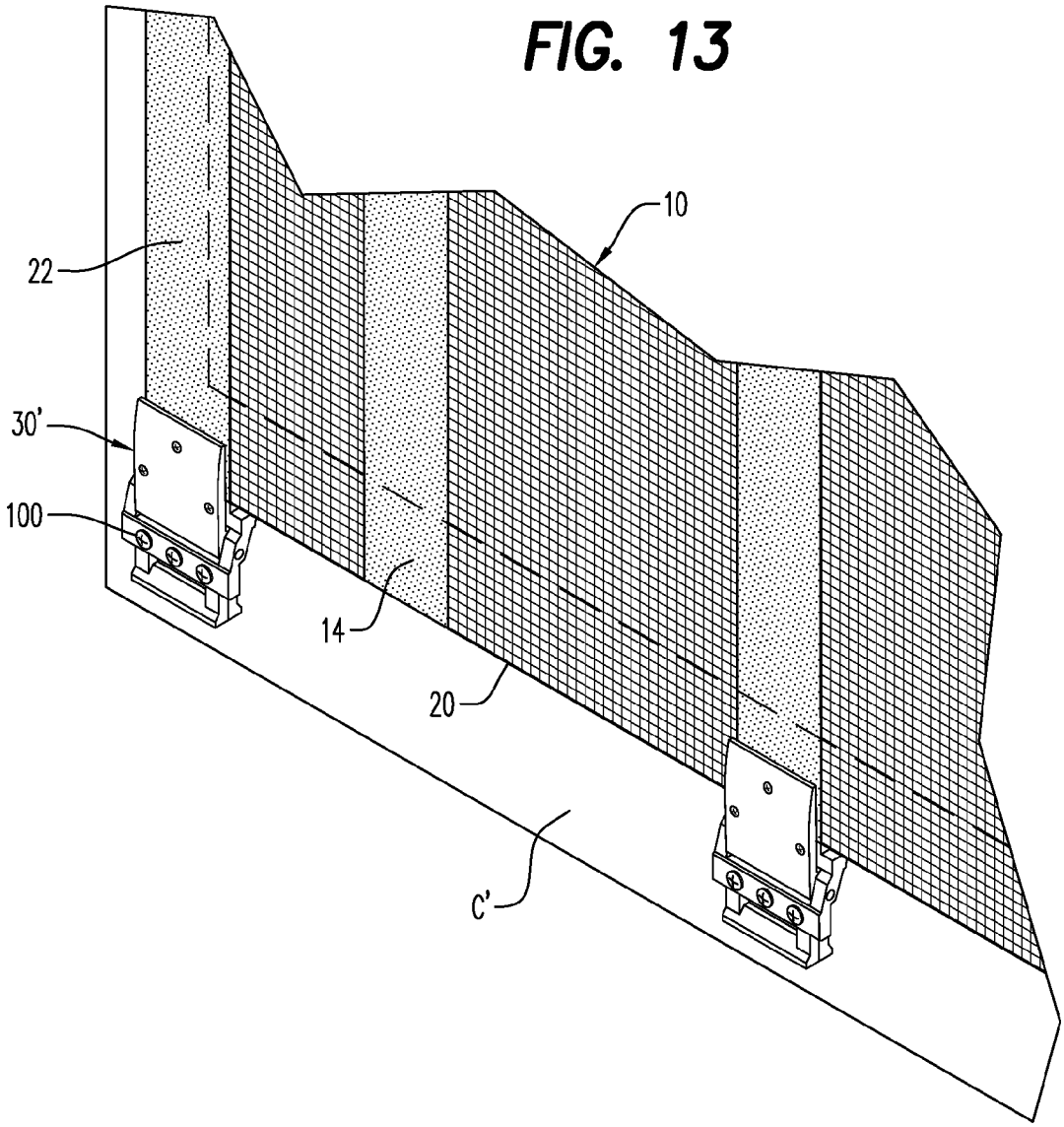
FIG. 13 is a perspective view of a lower portion of a system installation over a building opening utilizing the buckle/anchor of FIG. 11.

Referring lastly to FIGS. 11 to 13, an alternate embodiment of the molded reinforced plastic buckle is there shown at 30' and includes jaws 52' and 54' as previously described which are pivotally connected along axis 60' and provided with screw securement cavities 66'. The transverse strap slot 62' functions as previously described to tighten the jaws 52' and 54' together against the screening material and thickened area when the anchoring strap 32 is engaged therethrough with buckle 36 as previously described. However, the buckle 30' may also be permanently secured directly to the window frame C by installing fasteners 100 through the screw cavities 96 into the lower transverse frame C' when the jaws 52' and 54' have been lockingly engaged onto the thickened areas shown typically at 22, thus eliminating the need for the anchor strap 32 and effecting a more secure installation.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A hurricane screen protection system for protecting an opening of a building from impact damage, the opening having a first frame and a second frame traversing opposite ends of the opening, said system comprising:

a length of flexible screening material having a substantially uniform continuous cross-section, said screening material having a first edge and an opposite second edge and being sized to cover the building opening;

a pair of outer thickened areas and at least one inner thickened area connected to said screening material and extending from said first edge to said second edge along an entire length of said screening material, each of said pair of outer thickened areas extending along one of a pair of sides of said screening material, and said at least one inner thickened area disposed between said outer thickened areas; and a plurality of buckles each having a pair of jaws pivotally connected about a pivot point between a first end and a second end, each of said second ends of said pair of jaws includes corresponding mating slots that extend in a width direction of said buckle, wherein said first edge of said screening material is anchored to the first frame, and said outer thickened areas and said at least one inner thickened area adjacent said second edge are gripped between said first ends of each of said plurality of buckles, said mating slots are in communication to form an elongated slot extending through said buckle when said pair of jaws are in a closed position with said first ends gripping said thickened areas and said second ends being in abutting contact and wherein said second ends of said jaws are anchored to the second frame in order to place the screening material under tension.

2. The hurricane screen protection system as set forth in claim 1, wherein:

each of said thickened areas is formed of a separate length of flexible fabric strap material coextensive with, and connected to one surface of, said screening material.

3. The hurricane screen protection system as set forth in claim 2, wherein:

each of said fabric straps is connected to said screening material by stitching.

4. The hurricane screen protection system as set forth in claim 2, wherein:

each of said fabric straps is connected to said screening material by heat welding.

5. The hurricane screen protection system as set forth in claim 2, wherein:

each of said thickened areas is formed of two separate lengths of flexible fabric strap material coextensive with, and connected on each surface of said screening material.

6. The hurricane screen protection system as set forth in claim 1, wherein:

each of said thickened areas is formed by folding said screening material back onto itself into a Z shaped compressed and flattened fold lengthwise of said screening material and permanently establishing each of said folds by stitching.

7. The hurricane screen protection system as set forth in claim 1, wherein:

each of said thickened areas is formed by folding said screening material back onto itself into a Z shaped compressed and flattened fold lengthwise of said screening material and permanently establishing each of said folds by heat welding.

8. The hurricane screen protection system as set forth in claim 1, wherein said screening material being severable lengthwise along an outer edge of one said thickened area wherein the width of said screening material may be made generally equal to the width of the building opening.

9. The hurricane protection screen system as set forth in claim 1, wherein a strap extends through said elongated slot formed by said pair of corresponding mating slots in each of said second ends of said pair of jaws, said strap having one end anchored to the second frame, and wherein a portion of said strap extends through an adjustable buckle to provide a connection operable to adjust the tension of said screening material.

10. A hurricane screen protection system for protecting an opening of a building from impact damage, the opening having a first frame and a second frame traversing opposite ends of the opening, said system comprising:

a length of flexible screening material having a substantially uniform continuous cross-section, said screening material having a first edge and an opposite second edge and being sized to cover the building opening;

a pair of outer thickened areas and at least one inner thickened area connected to said screening material and extending from said first edge to said second edge along an entire length of said screening material, each of said pair of outer thickened areas extending along one of a pair of sides of said screening material, and said at least one inner thickened area disposed between said outer thickened areas; and a plurality of buckles each having a pair of jaws pivotally connected about a pivot point between a first end and a second end, each of said plurality of buckles includes a corresponding molded cavity formed in each of said jaws, said molded cavities forming a through space when said buckles are in a closed position, wherein said first edge of said screening material is anchored to the first frame, and said outer thickened areas and said at least one inner thickened area adjacent said second edge are gripped between said first ends of each of said plurality of buckles, and wherein a fastener extends through said through space and into the second frame to anchored said buckles to the second frame and place the screening material under tension.

11. The hurricane protection screen system as set forth in claim 10, wherein said corresponding molded cavities are formed in said jaws between said pivot point and said first end to fixedly secure said thickened areas between said first ends of said jaws and to anchor said buckle to the second frame.

* * * * *